US007066347B2

(12) United States Patent
Slovak et al.

(10) Patent No.: US 7,066,347 B2
(45) Date of Patent: Jun. 27, 2006

(54) ONE PIECE TRANSPARENT COOLER

(76) Inventors: David M Slovak, P.O. Box 2151, Umatilla, FL (US) 32784-2462; Roy E Bentley, II, 1810 N. Country Rd. 19A, Eustis, FL (US) 32726

( * ) Notice: Subject to any disclaimer, the term of this patent is extended or adjusted under 35 U.S.C. 154(b) by 218 days.

(21) Appl. No.: 10/680,401

(22) Filed: Oct. 7, 2003

(65) Prior Publication Data

US 2005/0145635 A1 Jul. 7, 2005

(51) Int. Cl.
*B65D 25/28* (2006.01)

(52) U.S. Cl. ..... 220/754

(58) Field of Classification Search ..... 220/754, 220/592.03, 592.27, 592.05, 592.26, 662, 220/665; 229/117.09, 117; 294/157, 153, 294/170, 145, 154; 16/426
See application file for complete search history.

(56) References Cited

U.S. PATENT DOCUMENTS

| | | | | | |
|---|---|---|---|---|---|
| 2,538,524 | A * | 1/1951 | Joseph | 220/592.27 |
| 3,194,462 | A * | 7/1965 | Tupper | 294/170 |
| 3,220,626 | A * | 11/1965 | Tupper | 294/137 |
| 3,678,703 | A | 7/1972 | Cornish et al. | |
| 4,024,731 | A | 5/1977 | Branscum | |
| 4,047,633 | A * | 9/1977 | Trombly | 220/592.2 |
| 4,886,187 | A * | 12/1989 | Stewart | 220/592.26 |
| 5,231,850 | A * | 8/1993 | Morris | 62/457.6 |
| 5,259,215 | A | 11/1993 | Rocca | |
| 5,470,119 | A * | 11/1995 | Huf | 294/157 |
| 5,505,307 | A | 4/1996 | Shink | |
| 5,638,896 | A | 6/1997 | Nishino et al. | |
| 5,918,478 | A | 7/1999 | Bostic et al. | |
| 6,247,328 | B1 | 6/2001 | Mogil | |
| 6,415,928 | B1 | 7/2002 | Giacci | |
| 2001/0054569 | A1 * | 12/2001 | Bisbal et al. | 206/756 |
| 2005/0011216 | A1 * | 1/2005 | Letton | 62/371 |

* cited by examiner

*Primary Examiner*—Stephen Castellano
(74) *Attorney, Agent, or Firm*—Michael I Kroll

(57) ABSTRACT

The invention is a one-piece transparent, portable cooler with air gaps positioned within the sidewalls providing insulation properties and means for easily viewing the contents of the cooler from any angle. In addition to the obvious advantage to security personnel in being able to quickly screen the contents, the present invention provides envelopes on the sides and top of the cooler with the envelopes conforming substantially in size to its respective side or top. These can be easily inserted and removed through the access slots provided.

7 Claims, 10 Drawing Sheets

ONE PIECE TRANSPARENT COOLER

BACKGROUND OF THE INVENTION

1. Field of the Invention

The present invention relates generally to containers for holding materials for storage, more specifically, to a transparent cooler for storing perishable foods.

For many years coolers have been regularly used for all types of working and recreational occasions. Whether the cooler is being used to keep items cold or warm, we use coolers when we're working and when we're playing. They go with us to construction sites and sporting events. We toss them into pickup trucks and fishing boats.

Unfortunately, due to recent international events including the threat of terrorism and other acts of violence, security measures have been tightened at many public events and venues. Safety and security for guests, employees, entertainers and players have always been a concern, but these recent events have prompted security measures that include exclusion or limitation of many items including the use of coolers from such venues. Many security measures include limiting the package size and type.

Commonly such events have continued to accept transparent packages and coolers due to the ease and ability to inspect the contents in an expeditious way.

The present invention's transparent cooler meets the demands of the new security measures and provides the user improved means to maintain and store perishable foods. The construction of the present invention's cooler includes side panels and a top cover that are made of a clear plastic or like material that allows the user or others to view the contents within the cooler.

In an additional preferred element in the construction of the present invention's end and sidewalls, the transparent plastic or like material has exterior panels forming envelopes. The envelopes provide means to insert sun reflective materials and/or interchangeable decorative coverings. The removable sun reflective panels can be inserted in any or all of the four sides and/or top creating a sun block barrier.

Artistically, the sun reflective panels may include pictorial or decorative coverings to suit the user or to reflect the event (favorite team, player, or the like).

Still yet another additional element of the present invention includes an alternate construction of the transparent cooler utilizing a top mounted lifting handle in lieu of end panel handles. The handle is supported by looped straps that wrap each corner of the base.

2. Description of the Prior Art

There are containers for holding materials for storage. Typical of these is U.S. Pat. No. 3,678,703 issued to Edward Cornish et al. on Jul. 25, 1972.

A patent was issued on May 24, 1977 as U.S. Pat. No. 4,024,731 to Tony E. Branscum. Another patent was issued to David D. Rocca on Nov. 9, 1993 as U.S. Pat. No. 5,259,215. Yet another U.S. Pat. No. 5,505,307 was issued to Joseph M. Shink on Apr. 9, 1996 and still yet another was issued on Jun. 17, 1997 to Yoshiya Nishino et al. as U.S. Pat. No. 5,638,896.

U.S. Pat. No. 5,918,478 was issued to William M. Bostic et al. on Jul. 6, 1999. Another patent was issued to Melvin S. Mogil on Jun. 19, 2001 as U.S. Pat. No. 6,247,328. Yet another U.S. Pat. No. 6,415,928 was issued to William J. Giacci on Jul. 9, 2002.

U.S. Pat. No. 3,678,703

Inventor: Edward Cornish et al.

Issued: Jul. 25, 1972

Container for holding material during storage or transportation in which the separable, insulated cover contains a body of heat-absorbing substance thermally exposed to the interior of the container through heat-conducting inside face of the cover, the cover being capable of being formed from a single piece of fiberboard or other sheet metal.

U.S. Pat. No. 4,024,731

Inventor: Tony E. Branscum

Issued: May 24, 1977

A refreezable container for a cold storage structure which can be releasably secured to the lid of the structure is the subject of the present invention. The container comprises yieldable spaced apart sidewalls which form an enclosure for holding a refreezable liquid. A passageway through the enclosure and its sidewalls receives an elongated stud. The stud has a gripping surface at one end and is threaded on the other end. Along the length of the stud a lateral projection extends outwardly so that the combined dimension of the projection and the stud is greater than the corresponding dimension of the passageway. The yieldable passageway walls permit insertion of the stud which may then be turned to screw the threaded stud into a correspondingly threaded receptacle in the lid of the cold storage structure.

U.S. Pat. No. 5,259,215

Inventor: David D. Rocca

Issued: Nov. 9, 1993

A cooler that allows for its transportability by the selective attachment to the cooler structure of axle and wheel assembly to the undercarriage of the cooler as desired. By the affixing to the undercarriage of the cooler mounting blocks that are capable of selectively receiving the axle portion of a wheel and axle assembly in rotational mechanical inter-fit, the features and advantages of the proposed invention are achieved.

U.S. Pat. No. 5,505,307

Inventor: Joseph M. Shink

Issued: Apr. 9, 1996

An insulated cooler which can be mounted to the floor of an automobile and provides access to open beverage containers. The cooler includes an insulated box which has a front wall separated from a back wall by a pair of side walls. The front, back and side walls are attached to a bottom wall that together define an inner cavity. The insulated cooler also has a top cover adapted to enclose the inner cavity of the box. The insulated box is small enough to be placed between the driver and front passenger of an automobile. The cooler has a strip of hook and loop material which can secure the bottom wall of the box to the carpet of the car. Additionally, the top cover has a pair of apertures adapted to receive beverage containers. The apertures may be covered by a flap which can be fastened to either the front or back walls of the box.

U.S. Pat. No. 5,638,896

Inventor: Yoshiya Nishino

Issued: Jun. 17, 1997

The present invention relates to a cold-hot storage box which can be used as a constant temperature box, a refrigerator for household use, or a freezer, and to a manufacturing method therefor. The cold-hot box of the present invention being characterized by the provision of an insulating container comprising a space of a double walled container made from an inner container and an outer container, enclosing at least one gas having low thermal conductivity selected from the group consisting of xenon, krypton, and argon.

U.S. Pat. No. 5,918,478

Inventor: William M. Bostic et al.

Issued: Jul. 6, 1999

A lightweight, insulated chest and method are provided for transportation and storage of perishable and other items which require a temperature-controlled environment. The chest includes insulated side walls, bottom and a hinged cover which is pneumatically sealed to prevent tampering and for thermal security. The chest includes a fluid conduit within the cover for air evacuation and depressurization of the interior and also includes a conduit to provide a vacuum between the walls of the sides and bottom which contain a rigid polymeric foam insulation.

U.S. Pat. No. 6,247,328

Inventor: Melvin S. Mogil

Issued: Jun. 19, 2001

A portable soft sided insulated container has an impermeable liner that provides a liquid holding barrier. The liner is folded from a single monolithic plastic sheet to reduce or eliminate the need for heat welded seams. The liner seats within the container and has a releasable attachment around its lip for mating with the rim of the container. The container has an insulated lid so that the entire assembly may be closed. The liner can be removed for cleaning, or replacement if punctured. When not in use the entire assembly can be folded into a collapsed position for storage. The container has two storage chambers that share a common insulated dividing wall.

U.S. Pat. No. 6,415,928

Inventor: William J. Giacci

Issued: Jul. 9, 2002

A display container comprises a base having a planar supporting surface, the planar supporting surface being cant relative to horizontal along two orthogonal axes. The display container may also include a transparent cover disposed on the base, and a box foldingly enclosing the base and the transparent cover.

While these containers for holding materials for storage may be suitable for the purposes for which they were designed, they would not be as suitable for the purposes of the present invention, as hereinafter described.

SUMMARY OF THE PRESENT INVENTION

A primary object of the present invention is to provide a transparent container for holding materials for storage.

Another object of the present invention is to provide a transparent container with insulating means for holding perishable food items for storage.

Still another object of the present invention is to provide a transparent container with insulating means for holding hot materials for storage.

Yet another object of the present invention is to provide a transparent container with insulating means for holding cold materials for storage.

Still another object of the present invention is to provide a transparent container having exteriorly positioned envelopes on the sides and top.

Another object of the present invention is to provide a transparent container with means to have a sun reflective element contained within the walls and top of the container.

Yet another object of the present invention is to provide a transparent container with means to have a plurality of air spaces within the walls of the container.

Still another object of the present invention is to provide a transparent container that provides means for lifting from either the top cover or end panels.

Another object of the present invention is to provide a transparent container that is cost effective to manufacture.

Additional objects of the present invention will appear as the description proceeds.

The present invention overcomes the shortcomings of the prior art by providing an improved means for holding materials for storage in transparent containers. In addition to providing means for holding materials for storage with removable heat reflecting elements. Furthermore, providing a transparent container with means for having a plurality of envelope pouches formed on the walls of the container.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
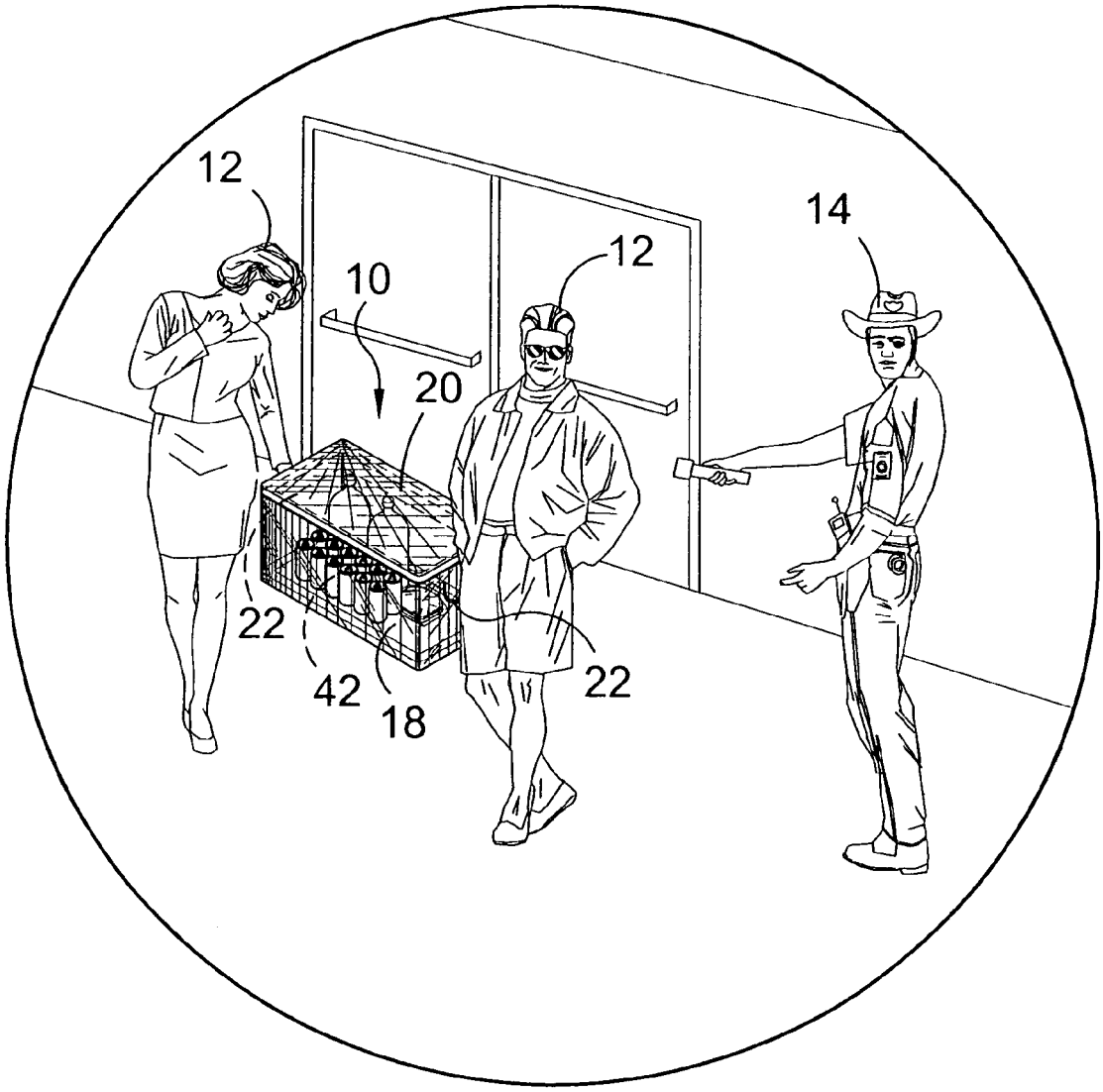
FIG. 1 is an illustrative view of the present invention in use.

Turning now descriptively to the drawings, in which similar reference characters denote similar elements throughout the several views, the figures illustrate the One-Piece Transparent Portable Cooler of the present invention. With regard to the reference numerals used, the following numbering is used throughout the various drawing figures.

10 One-Piece Transparent Portable Cooler
12 user
14 security personnel
15 cooler body
16 base
17 interior storage compartment
18 sidewall
20 cover
21 extruded lip of 20
22 handle
24 snap-on wall seal
26 insert envelope
28 decorative panel insert
30 wall member
32 inner sidewall
34 outer sidewall
36 insulating wall
38 air gap
40 compression seal
42 contents of 10
44 sealing channel
46 retaining flange
48 receiving element
50 top edge of 30
52 insert envelope panel
54 insert envelope recess
56 access slot of 52
58 alternate carrying device
60 base plate of 58
62 cord element of 58
64 looped end of 62
66 handle of 58

DETAILED DESCRIPTION OF THE PREFERRED EMBODIMENTS

The following discussion describes in detail one embodiment of the invention. This discussion should not be construed, however, as limiting the invention to those particular embodiments. Practitioners skilled in the art will recognize numerous other embodiments as well. For a definition of the complete scope of the invention, the reader is directed to the appended claims.

FIG. 1 is an illustrative view of the present invention 10 in use. The present invention 10 is a one-piece transparent, portable cooler 10 that provides means to view the contents 42 within the cooler 10. The present invention 10 is fabricated of a transparent plastic or other like material having clear sidewalls 18 and removable top cover 20. The transparency allows the user to see the contents 42 within the cooler 10 without opening the cover 20. The transparent cooler 10 is particularly useful for security inspections at sporting events and other controlled activities by allowing security personnel 14 to visually examine the contents 42 without having to open the cooler. Side handles 22 make the transport of the present invention 10 simple and easy.

Figure 2:
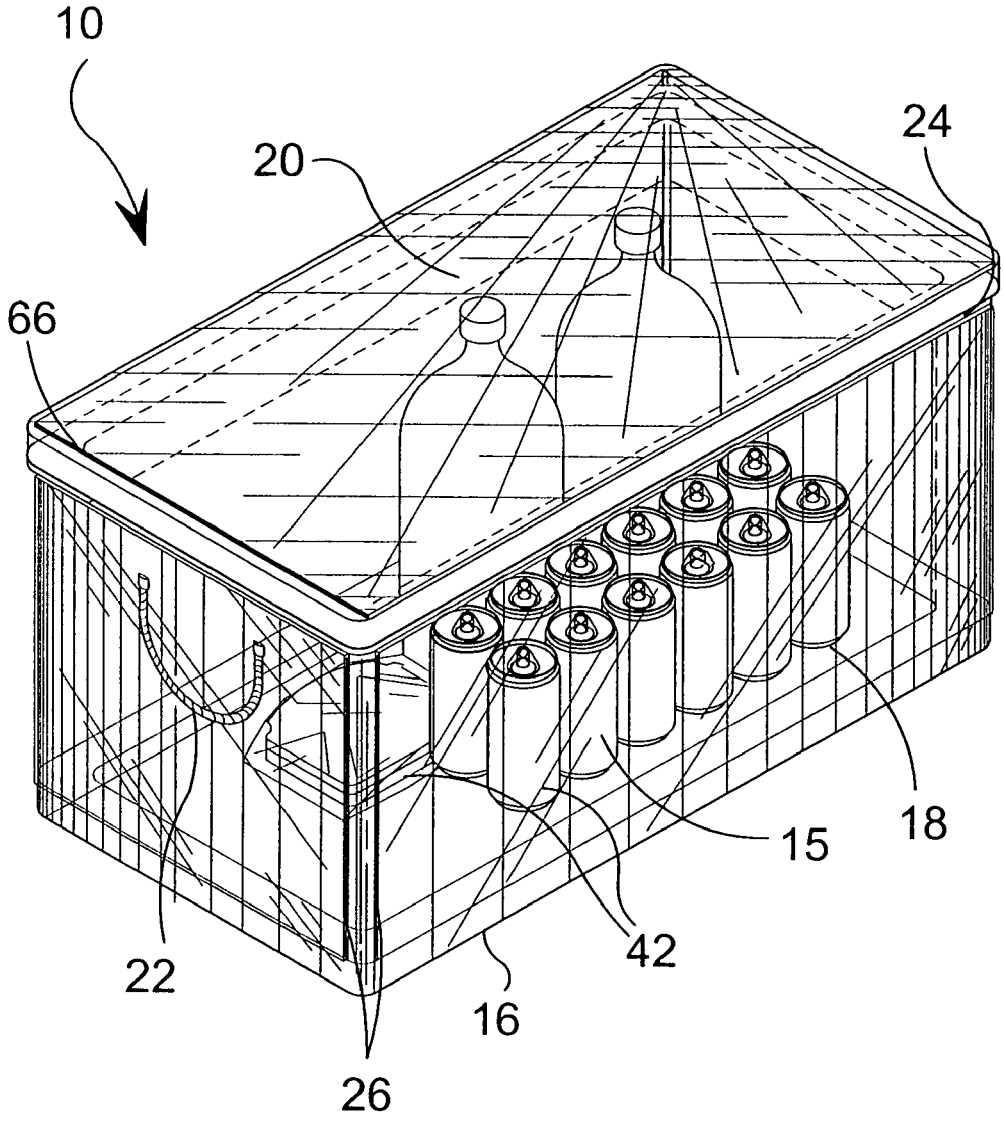
FIG. 2 is a perspective view of the present invention.

FIG. 2 is a perspective view of the present invention 10 in use. The present invention is a one piece transparent, portable cooler 10 that provides means to view the contents 42 therein without the need to remove the cover 20. The cooler of the present invention 10 is made of a transparent plastic or like material having a clear base 16 and sidewalls 18 with a removable top cover 20. The present invention 10 is particularly useful for security inspections at sporting events and other controlled activities. Side handles 22 make the transport of the present invention 10 simple and easy. Insert envelopes 26 are exteriorly disposed on and integral with all sidewalls 18 and the cover 20 to allow the user 12 to place decorative or functional panel inserts as desired.

Figure 3:
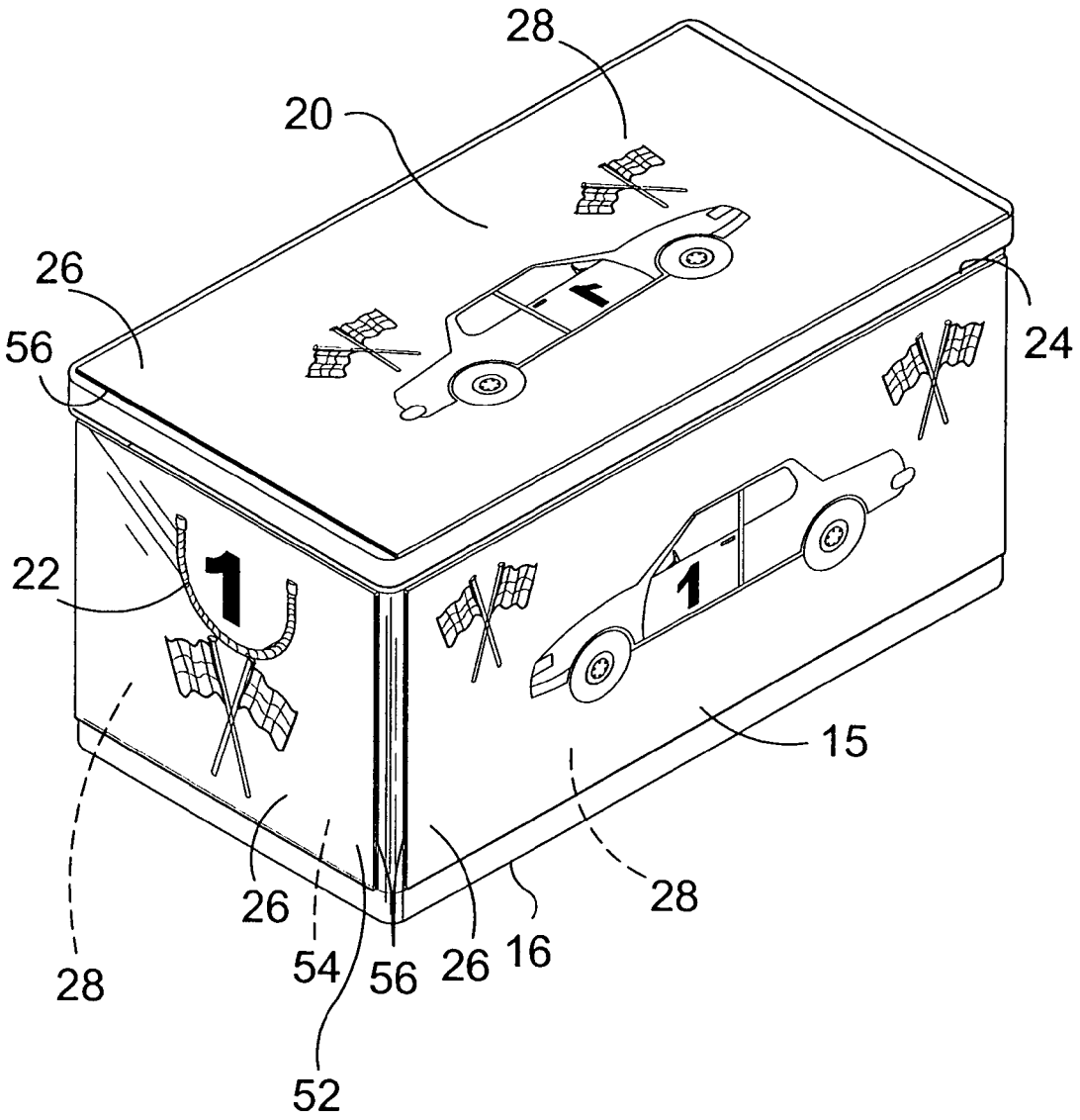
FIG. 3 is a perspective view of the present invention having decorative panels.

FIG. 3 is a perspective view of the present invention 10 with decorative panel inserts 28 placed within said insert envelopes 26. The present invention is a one-piece transparent, portable cooler 10 that provides means to view the contents 42 therein without the need to remove the cover 20. The cooler of the present invention 10 is made of a transparent plastic or like material having a clear body 15 and removable top cover 20. The present invention 10 also provides decorative panel inserts 28 that are inserted within the provided insert envelopes 26, top and sides. The present invention 10 is particularly useful for security inspections at sporting events and other controlled activities. Side handles 22 make the transport of the present invention 10 simple and easy. The insert envelope 26 is comprised of an insert envelope panel 52, insert envelope recess 54 and access slot 56 whereby the user selected decorative panel inserts 28 can be inserted and retained therein for the purposes of providing a decorative element in addition to protecting the interior storage compartment 17 from direct sunlight.

Figure 4:
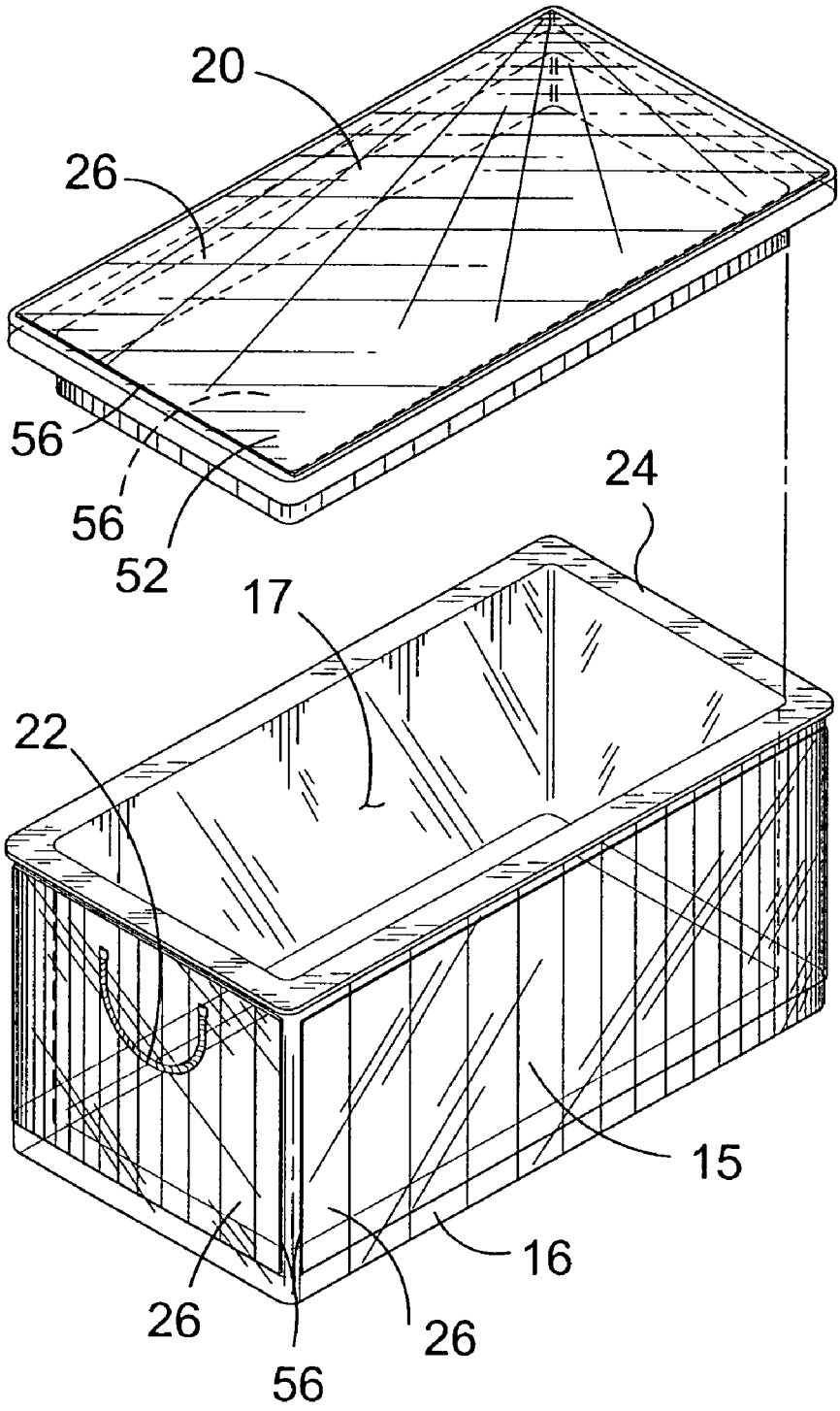
FIG. 4 is an exploded view of the present invention.

FIG. 4 is an exploded view of the present invention 10. Shown is an exploded view of the present invention 10, a one-piece transparent, portable cooler 10 that provides means to view the contents 42 therein without the need to remove the cover 20. The cooler of the present invention 10 is made of a transparent plastic or like material having a clear body 15 and removable top cover 20. The present invention 10 also provides decorative panel inserts 28 that are inserted within the provided insert envelopes 26, top and sides. The present invention 10 is particularly useful for security inspections at sporting events and other controlled activities. Side handles 22 make the transport of the present invention 10 simple and easy. As previously stated, the insert envelope 26 is comprised of an insert envelope panel 52, insert envelope recess 54 and access slot 56 whereby the user selected decorative panel inserts 28 can be inserted and retained therein for the purposes of providing a decorative element in addition to protecting the interior storage compartment 17 from direct sunlight while still providing means whereby a user can remove the inserts for inspection and easily place them back into their envelopes. Furthermore, because they are easily changed it would require little effort to design placards for display, as is evident in almost all stadium sporting events, and carry them to the stadium in the insert envelopes 26.

Figure 5:
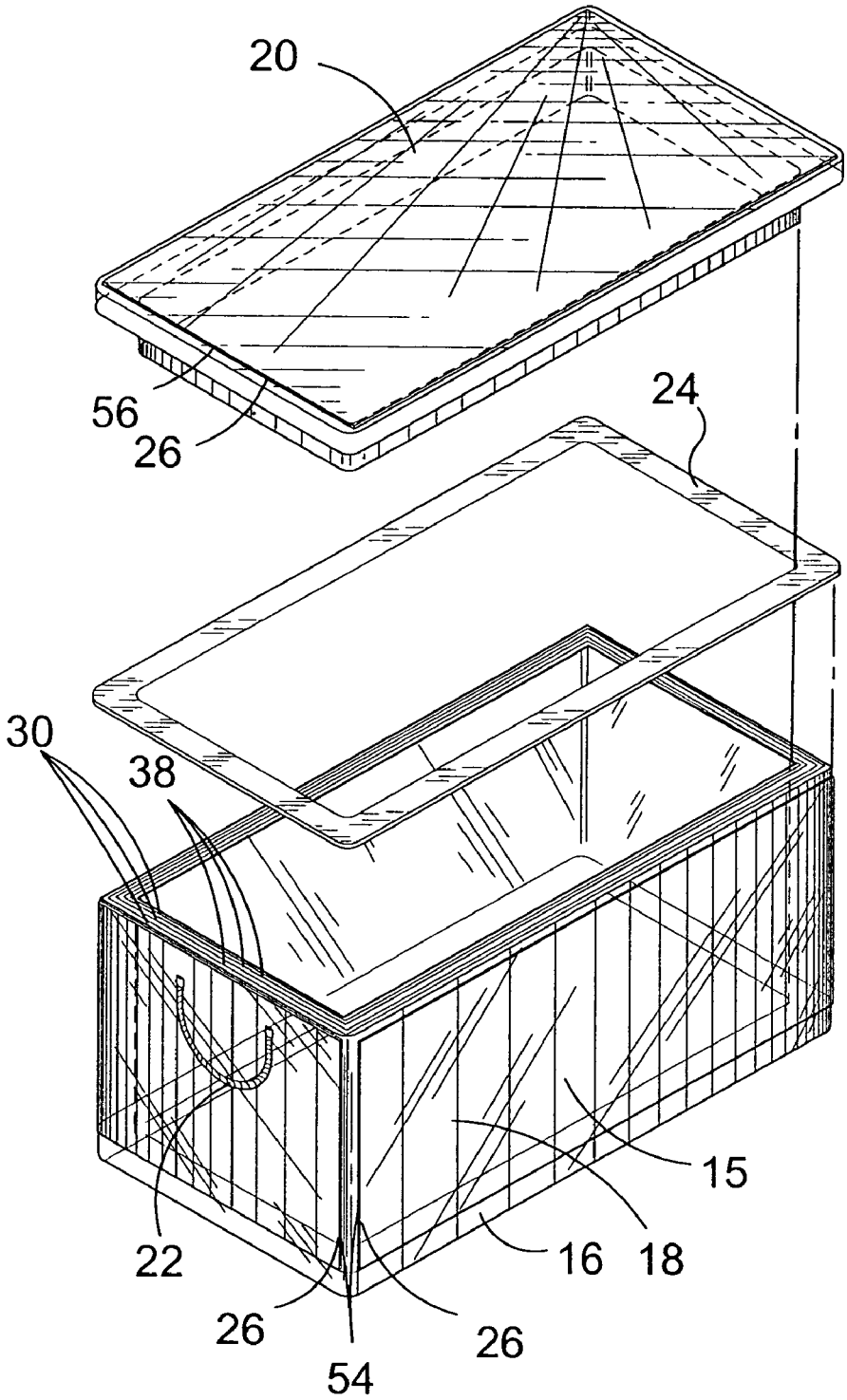
FIG. 5 is an exploded view with top wall seal removed from the present invention.

FIG. 5 is an exploded view with snap-on wall seal 24 removed from the body 15 of the present invention 10. Shown is an exploded view of the present invention 10 with cover 20 and snap-on wall seal 24 removed, exposing the air gaps 38 between the wall members 30. The cooler of the present invention 10 is made of a transparent plastic or like material having a clear base 16 and sidewalls 18 with a removable top cover 20. The present invention 10 is particularly useful for security inspections at sporting events and other controlled activities due to the ease of removing and re-inserting the decorative panel inserts 28 from their respective insert envelope 26.

Figure 6:
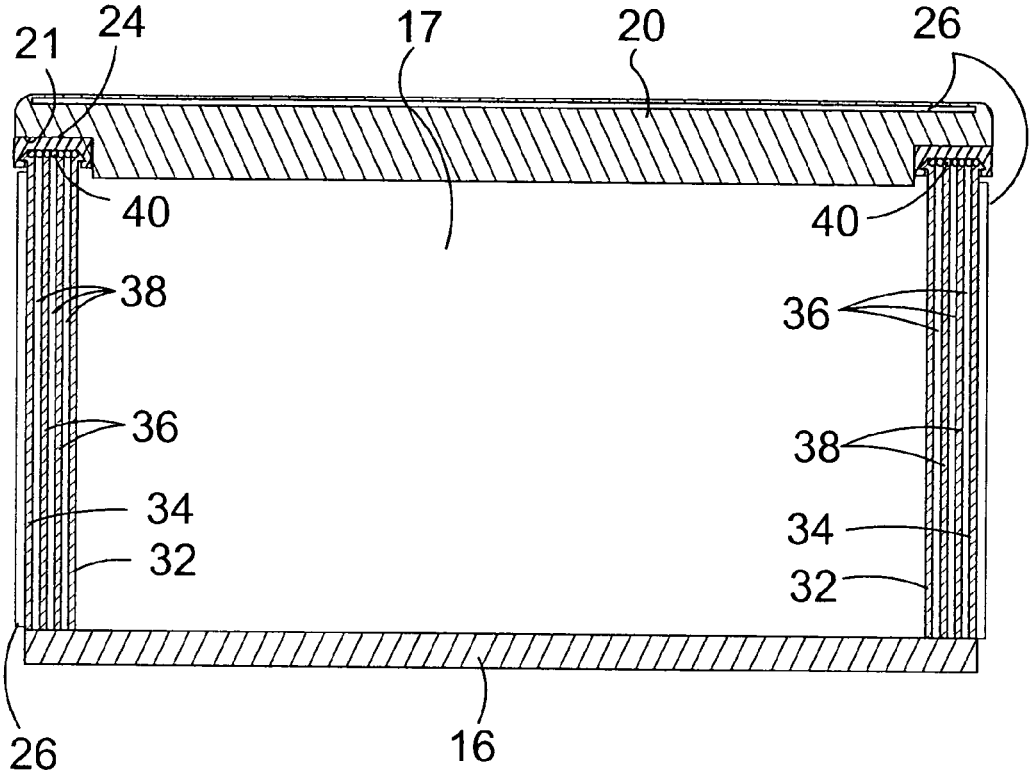
FIG. 6 is a sectional view of the present invention.

FIG. 6 is a sectional view of the present invention 10. Shown is a sectional view of the present invention, a one piece transparent, portable cooler 10 having air gaps 38 within the insulating walls 36 providing insulation properties. The cover 20 has an extruded lip 21 that fits firmly over the snap-on wall seal 24, sealing the interior storage compartment 17 and providing additional strength to the cooler body 15.

Figure 7:
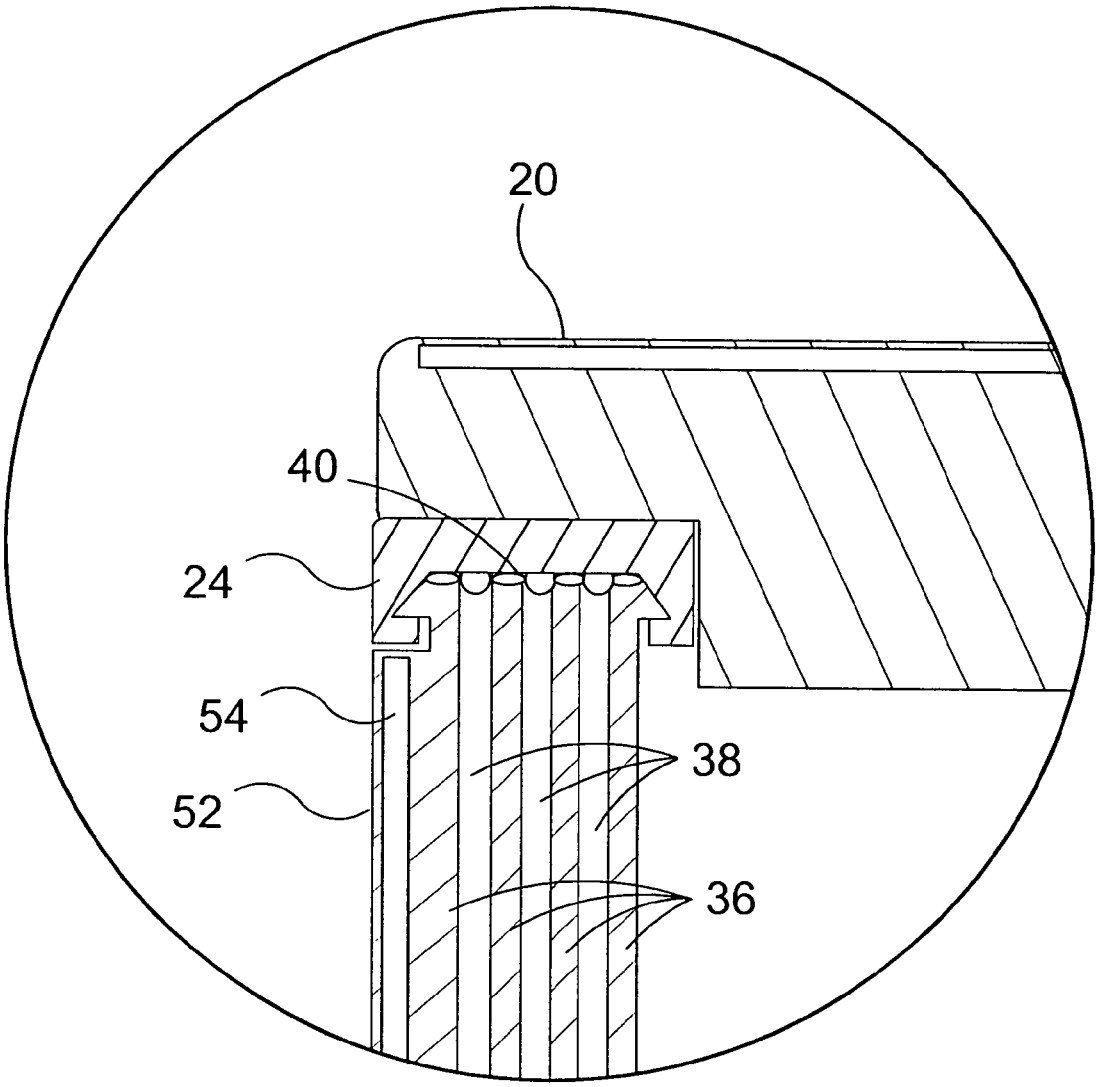
FIG. 7 is a detailed sectional view of the present invention.

FIG. 7 is a detailed sectional view of the present invention. Shown is a sectional view of the present invention 10, a one piece transparent, portable cooler 10 having air gaps 38 within the sidewalls 18 providing insulation properties. The cover 20 has an extruded lip 21 that fits firmly over the snap-on wall seal 24, sealing the interior storage compartment 17 and providing additional strength to the cooler body 15.

Figure 8:
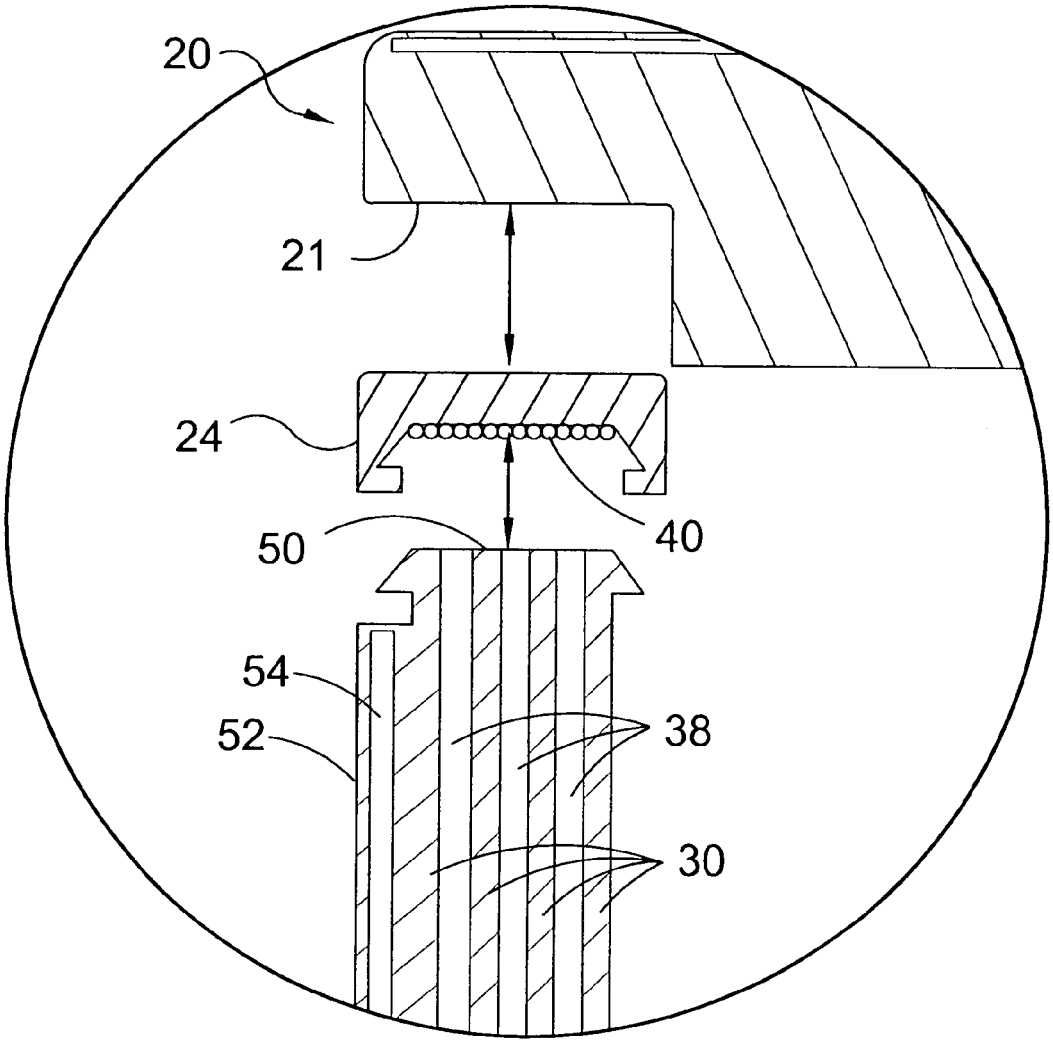
FIG. 8 is a detailed sectional view of the present invention.

FIG. 8 is a detailed sectional view of the present invention 10. Shown is a sectional view of the present invention 10 with snap-on wall seal 24 and cover 20 removed for clarity. The one piece transparent, portable cooler 10 comprises air gaps 38 within the sidewalls 18 providing insulative properties. The cover 20 has an extruded lip 21 that fits firmly over the snap-on wall seal 24, sealing the interior storage compartment 17 and providing additional strength to the cooler body 15.

Figure 9:
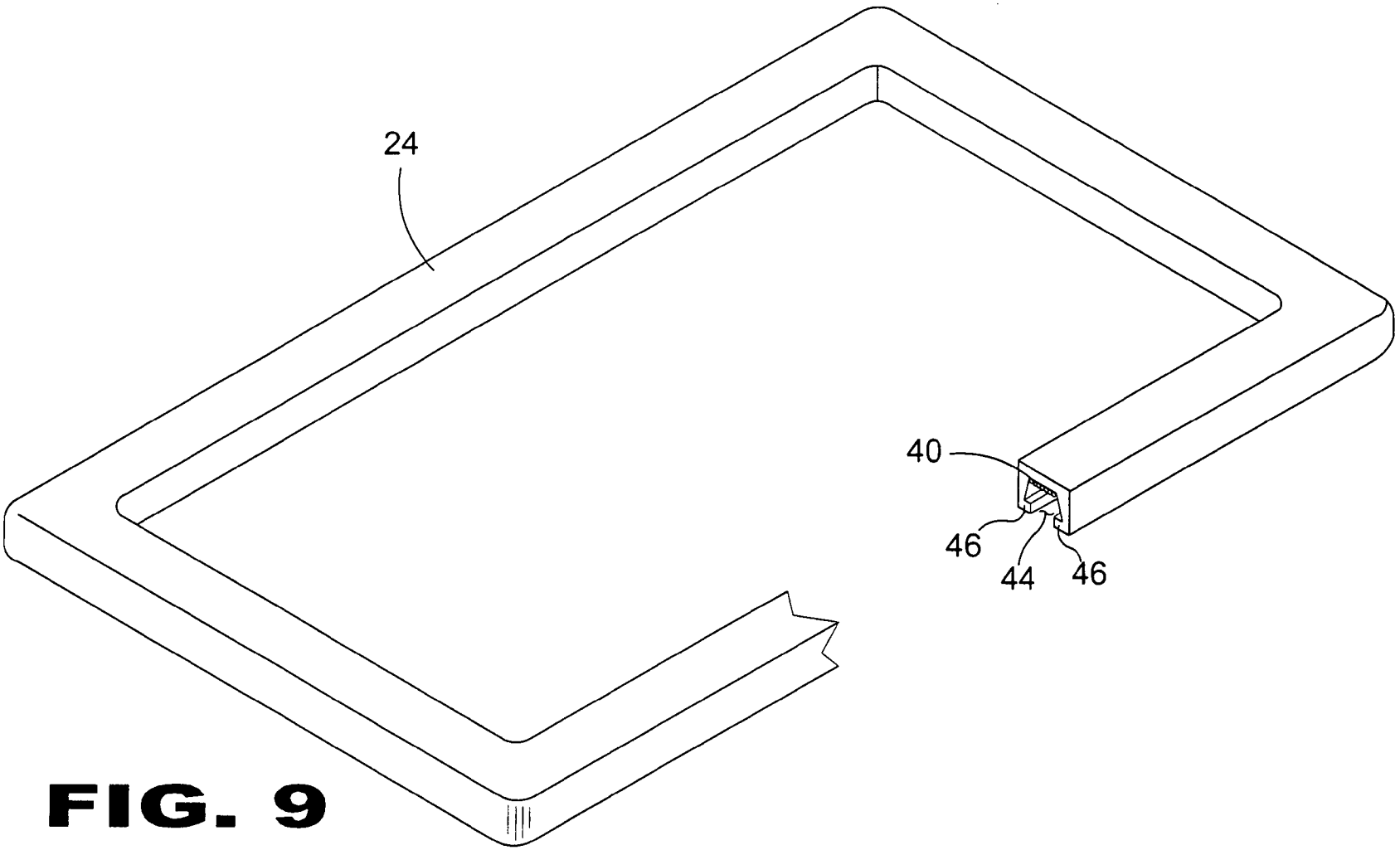
FIG. 9 is a perspective view of the top seal of the present invention.

FIG. 9 is a perspective view of the snap-on wall seal 24 of the present invention 10. Shown is a view of the top snap on seal 24 of the present invention 10 having a cutaway section showing the dovetail like sealing channel 44 and compression seal 40.

Figure 10:
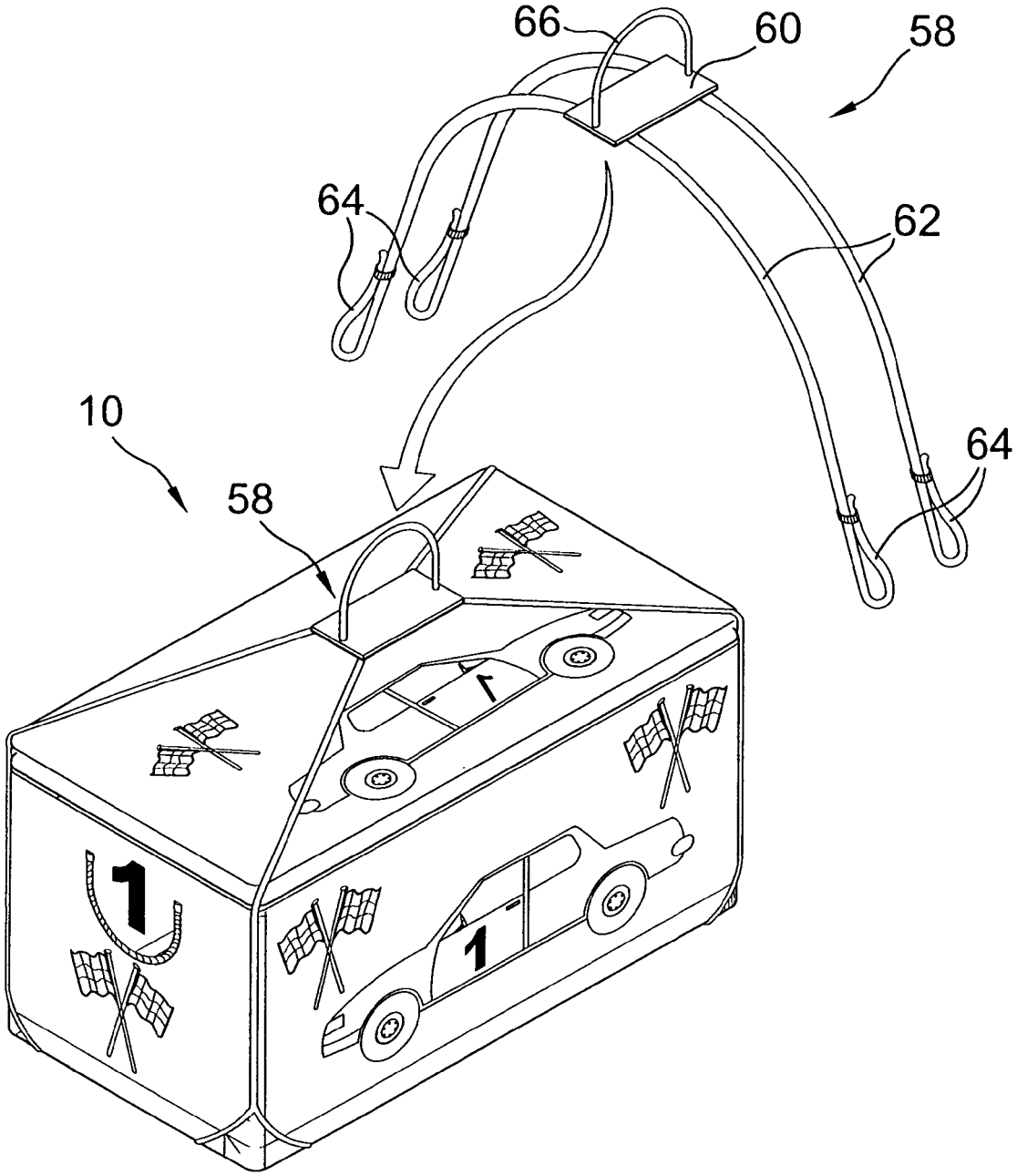
FIG. 10 is a perspective view of an alternate carrying device of the present invention.

FIG. 10 is a perspective view of an alternate carrying device 58 of the present invention 10. Shown is an alternate carrying device 58 of the present invention 10 having a handle 66 with cord elements 62 looped ends 64 for securing to the corner edges of the cooler of the present invention 10.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A one-piece transparent portable cooler comprising:

a) a body fabricated of a rigid transparent material comprising abase member with integral sidewalls extending vertically upward from the peripheral edges thereof thereby defining an interior storage compartment;

b) a removable cover fabricated of a rigid transparent material;

c) gripping means for carrying said cooler, and d) an alternate carrying device comprising a base plate having a pair of cord elements medially attached thereto with the four distal ends having secured loops for grasping the four bottom corners of said cooler and a handle element fastened to said base to allow the user to hold and carry the present invention with one hand.

2. A one-piece transparent portable cooler comprising:

a) a body fabricated of a rigid transparent material comprising abase member with integral sidewalls extending vertically upward from the peripheral edges thereof thereby defining an interior storage compartment;

b) a removable cover fabricated of a rigid, transparent material; and c) gripping means for carrying said cooler, wherein said sidewalls comprise a plurality of spaced apart wall members forming at least one insulating air gap therebetween, said spaced apart wall members of said sidewalk have a top edge forming an open recess between each said wall member and further including a means for sealing said top edge wherein said sealing means is snap-on top wall seal comprising:

i) a resilient top wall seal having a top, two sides and a bottom conforming substantially to the shape of and wider than said top edge of said wall members;

ii) a dove-tail shaped sealing channel extending from the bottom of said top wall seal and extending into the central portion thereof conformed to receive said top edge of said wall members;

iii) angular retaining flanges formed by said sealing channel on said bottom of said top wall seal and extending medially from the sides thereof;

iv) receiving elements for accepting and retaining said retaining flange disposed proximal to said top edge of said wall members and on the inner wall facing said interior storage compartment and on the exterior portion of said outer wall, said receiving elements arranged to cooperate with said angular retaining flanges to encourage the insertion of said top edge of said wall members into said sealing channel and to discourage the removal therefrom; and v) a compressible seal element disposed on the top of said sealing channel for the snug placement thereagainst of said top edge of said wall members when inserted therein to prevent entry into said insulating air gaps of condensation and other foreign elements.

3. A one-piece transparent portable cooler as recited in claim 1, wherein said spaced apart wall members include an inner wall and an outer wall.

4. A one-piece transparent portable cooler as recited in claim 3, wherein said spaced apart wall members further include at least one insulating wall member disposed between said inner wall and said outer wall thereby forming a plurality of insulating air gaps therebetween.

5. A one-piece transparent portable cooler as recited in claim 4, including two said insulating walls thereby forming three insulating air gaps between said inner wall and said outer wall.

6. A one-piece transparent portable cooler as recited in claim 2, wherein said insulating air gaps serve to restrict the transfer of heat between the interior of said cooler and the exterior.

7. A one-piece transparent portable cooler as recited in claim 2, further including at least one insert envelope comprising a thin transparent panel disposed in spaced apart relation to the exterior portion of said sidewall and peripherally in communication therewith on three sides with the fourth side remaining open to form an access slot into the ensuing insert recess.

* * * * *